US005832335A

United States Patent [19]

Fukasawa

[11] Patent Number: 5,832,335

[45] Date of Patent: Nov. 3, 1998

[54] CONTROL METHOD FOR A TRANSFER PROCESS IN AN ELECTROPHOTOGRAPHIC PROCESS

[75] Inventor: Hisashi Fukasawa, Niigata, Japan

[73] Assignee: NEC Corporation, Tokyo, Japan

[21] Appl. No.: 889,599

[22] Filed: Jul. 8, 1997

[30] Foreign Application Priority Data

Jul. 8, 1996 [JP] Japan ..... 8-176977

[51] Int. Cl.[6] ..... G03G 15/00

[52] U.S. Cl. ..... 399/66; 399/101

[58] Field of Search ..... 399/66, 101, 99, 399/98, 313, 100

[56] References Cited

U.S. PATENT DOCUMENTS

| | | | |
|---|---|---|---|
| 5,253,022 | 10/1993 | Takeuchi et al. | 399/66 |
| 5,540,565 | 7/1996 | Tomiki et al. | 399/66 |
| 5,692,232 | 11/1997 | Okano et al. | 399/313 X |
| 5,708,929 | 1/1998 | Adachi et al. | 399/149 |
| 5,729,788 | 3/1998 | Hirohashi et al. | 399/66 |

FOREIGN PATENT DOCUMENTS

| | | |
|---|---|---|
| 1-292385 | 11/1989 | Japan . |
| 3-69978 | 3/1991 | Japan . |
| 5-27605 | 2/1993 | Japan . |
| 5-341671 | 12/1993 | Japan . |
| 7-44069 | 2/1995 | Japan . |
| 8-211760 | 8/1996 | Japan . |

*Primary Examiner*—Arthur T. Grimley
*Assistant Examiner*—Quana Grainger
*Attorney, Agent, or Firm*—Foley & Lardner

[57] ABSTRACT

In a control method for a transfer roller, after detecting an interval between a first recording medium and a second recording medium following the first recording medium, one of a first control mode and a second control mode is selected. If the first control mode is selected, and if the interval is not longer than a time period corresponding to one turn of the transfer roller, the transfer roller is kept at a first voltage until a second transfer to the second recording medium is completed. If the second control mode is selected, and if the interval is longer than the time period corresponding to one turn, the transfer roller changes between the first voltage and a second voltage which are opposite in polarity, before the second transfer to the second recording medium.

18 Claims, 9 Drawing Sheets

CONTROL METHOD FOR A TRANSFER PROCESS IN AN ELECTROPHOTOGRAPHIC PROCESS

BACKGROUND OF THE INVENTION

1. Field of the Invention

The present invention generally relates to an image forming apparatus using an electrophotographic process, and in particular to a control method and apparatus for a transfer process in the electrophotographic process.

2. Description of the Related Art

In an electrophotographic process employed in image forming apparatuses including a printer, a copy machine and a facsimile machine, cleaning of a transfer roller is a necessary step in the transfer process. The transfer roller which is opposed to a photosensitive drum is used to transfer a toner image on the surface of the photosensitive drum to a recording medium. In the transfer process, extra toner on the areas other than the image area is also attracted and deposited on the transfer roller. Therefore, without cleaning the transfer roller, dirt due to the deposited toner would be made on the back surface of the recording medium. Several cleaning methods for the transfer roller have been proposed.

A conventional cleaning method has been disclosed in Japanese Patent Laid-open No. 5-341671. According to the method, a cleaning of a transfer roller is performed for a predetermined period when power is turned on or when the machine is restarted after paper jam. During the first half of the transfer roller cleaning period, a voltage of the same polarity as the charged toner is applied to the transfer roller, and then, during the second half thereof, another voltage of the same polarity as the transfer bias is applied to the transfer roller. Thereby, extra toner is transferred from the transfer roller back to the photosensitive drum.

Another conventional cleaning method has been disclosed in Japanese Patent Laid-open No. 1-292385. According to this method, when the transfer process is not performed, toner is transferred from the transfer roller back to the photosensitive drum by applying appropriate voltages to the transfer roller and a charge roller, respectively, in the interval during which the transfer process is not performed.

SUMMARY OF THE INVENTION

However, when the transfer process has not been performed for a relatively long time, in other words, the interval during which the transfer process is not performed becomes longer in the electrophotographic process, the voltage of the same polarity is continuously applied to the transfer roller during the interval. Especially when the transfer roller is of ionic conduction, continuously applying such a voltage to the transfer roller causes the resistance of the transfer roller to be increased, resulting in deteriorated transfer of the toner image especially in low-temperature and low-humidity environments.

An object of the present invention is to provide a control method and apparatus which can avoid the transfer deterioration even in the case where the interval during which the transfer process is not performed becomes longer in the electrophotographic process.

Another object of the present invention is to provide a control method and apparatus which can transfer a developer on a transfer roller back to an image carrying member with reliability.

According to the present invention, in a control method for a transfer roller which is used to transfer a developer image on an image carrying member to a recording medium according to an electrophotographic process, after detecting an interval between a first recording medium and a second recording medium which follows the first recording medium, one of a first control mode and a second control mode is selected depending on whether the interval is longer than a circumference of the transfer roller after a first transfer to the first recording medium is completed. The first control mode is selected when the interval is not longer than the circumference of the transfer roller and the second control mode is selected when the interval is longer than the circumference of the transfer roller. In the first control mode, the transfer roller is kept at a first voltage until a second transfer to the second recording medium is completed. In the second control mode, the transfer roller changes between the first voltage and a second voltage before the second transfer to the second recording medium, the first voltage and the second voltage being opposite in polarity.

Since the transfer roller changes between the first voltage and a second voltage before the second transfer to the second recording medium in the second control mode, it avoids causing the resistance of the transfer roller to be increased, resulting in reliable transfer of the developer image.

In the second control mode, the second voltage may be applied to the transfer roller for a first time period and then the first voltage may be applied to the transfer roller for a second time period following the first time period.

Preferably, the second time period is longer than the circumference of the transfer roller. Since a turn of the transfer roller is made during the second time period, the reliable transfer of the develop image can be achieved.

DETAILED DESCRIPTION OF THE PREFERRED EMBODIMENT

Hereinafter, an image forming apparatus according to an embodiment of the present invention will be described, taking a reversal development method as an example. The reversal development method uses developer (toner) having non-magnetic and negatively charged properties. Needless to say, a normal development method may be used with only reversing the respective polarities of voltages applied to the image forming apparatus.

Figure 1:
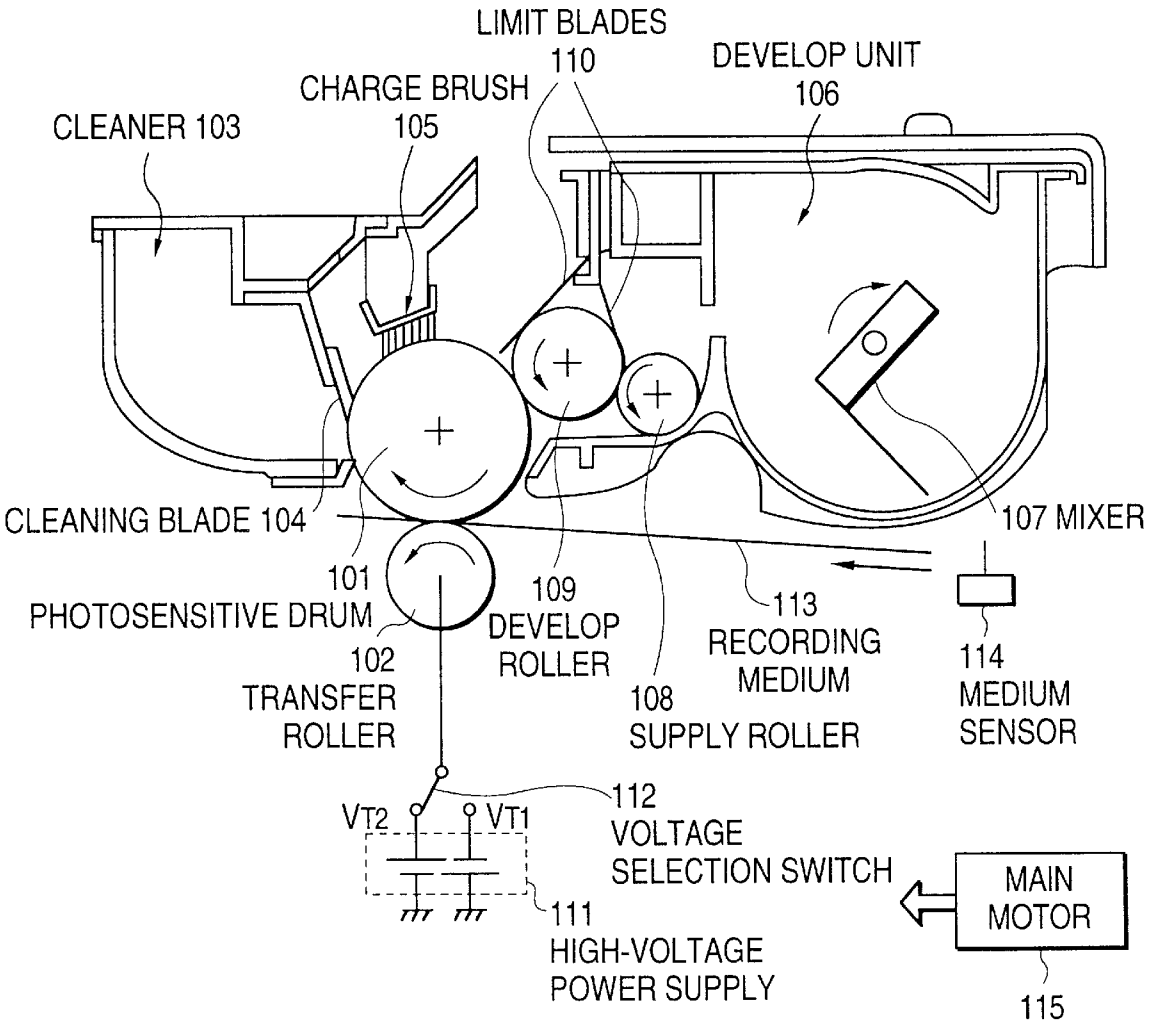
FIG. 1 is a sectional view showing an electrophotographic image forming apparatus according to an embodiment of the present invention.

Referring to FIG. 1, a photosensitive drum 101 is an image carrying medium which is shaped like a roller. Around the photosensitive drum 101, a transfer roller 102, a cleaner 103 having a cleaning blade 104, a charge brush 105, and a develop unit 106 are placed. The develop unit 106 is comprised of a toner mixer 107, a toner supply roller 108, a develop roller 109, and limit blades 110. The toner mixer 107 mixes toner contained therein and the toner is supplied to the develop roller 109 by the toner supply roller 108. The develop roller 109 is in contact with the photosensitive drum 101 to develop an electrostatic latent image on the photosensitive drum 101 by adhesion of the toner. The electrostatic latent image on the photosensitive drum 101 is formed by light emitted from a laser light source (not shown) which is driven according to image data.

The transfer roller 102 is connected to a high-voltage power supply 111 through a voltage selection switch 112. The high-voltage power supply 111 generates two direct current voltages $V_{T1}$ and $V_{T2}$ which are opposite in polarity. The voltage selection switch 112 selects one of the voltages $V_{T1}$ and $V_{T2}$ to supply it to the transfer roller 102 according to a selection control signal received from a control processor which will be described later. The electrophotographic process including charge, latent image formation, development, transfer, and cleaning is performed by the above components. More specifically, a recording medium 113 such as a paper is conveyed and is detected by a medium sensor 114 which is located upstream from the contact point of the photosensitive drum 101 and the transfer roller 102. The developed toner image on the photosensitive drum 101 is transferred to the recording medium 113 by the transfer roller 102 to which the positive voltage $V_{T2}$ is applied. The photosensitive drum 101, the transfer roller 102, the develop roller 109 and the like are rotated by a main motor 115 under the control of the control processor.

The photosensitive drum 101 is made of OPC and the like and the transfer roller 102 is a flexible and conductive roller which is made of a conductive form such as silicone, urethane, or EPDM. The charge brush 105 is a brush-shaped conductive element which is made of rayon or acrylic. A charge roller may be used instead of the bruch. The develop roller 109 is made of surface-processed natural rubber or sponge. The develop roller 109 may be made of flexible and conductive material which is coated with nylon rubber or urethane rubber. The limit blades 110 are made of flexible material such as urethane rubber, silicone rubber or resin film. Alternatively the limit blades 110 may be a plate spring made of stainless steel.

Figure 2:
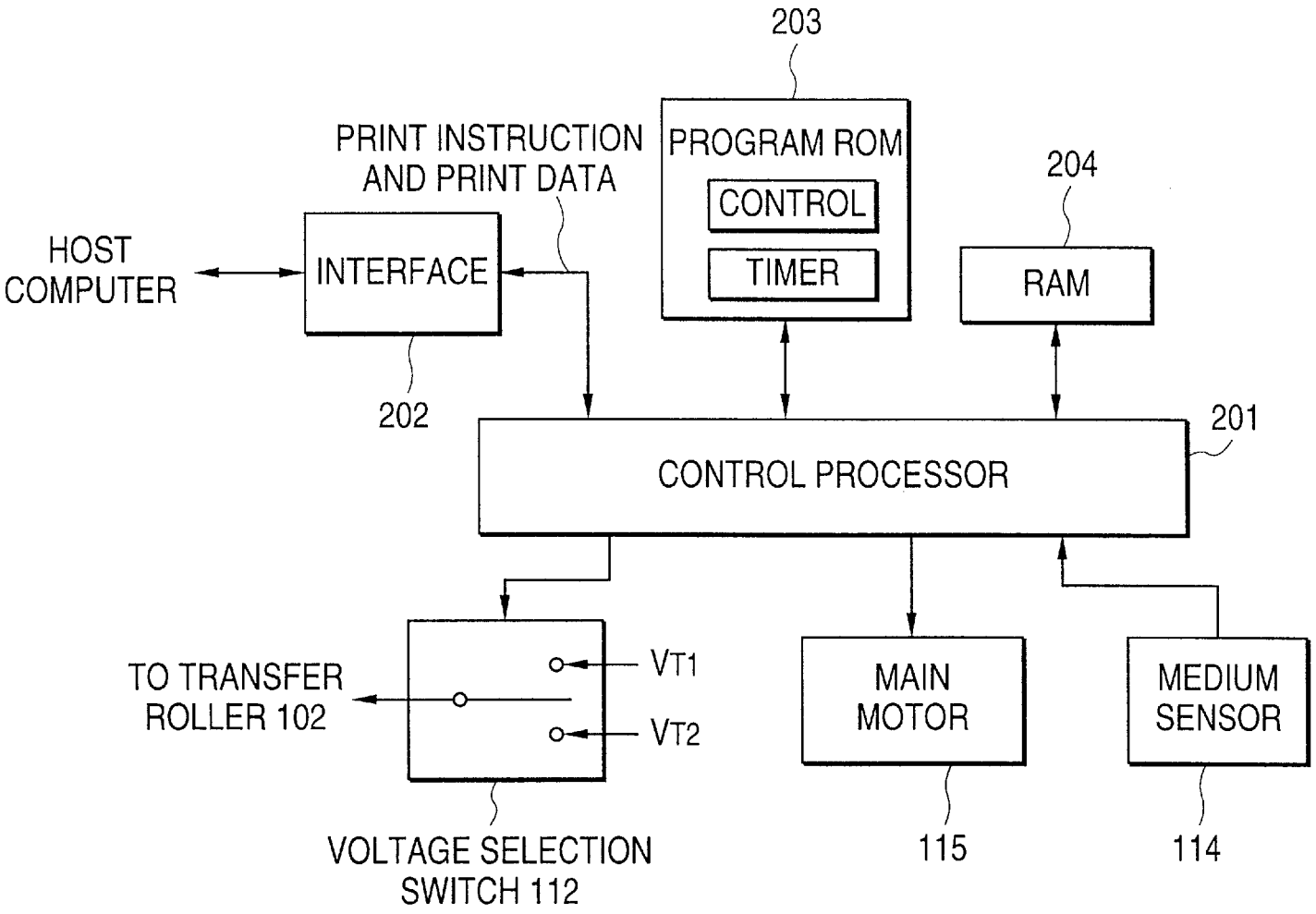
FIG. 2 is a block diagram showing a control apparatus for the transfer process according to the embodiment.

Referring to FIG. 2, the image forming apparatus as described above is provided with a control processor 201 and an interface 202 through which print instruction and print data are received from a host computer. The control processor 201 performs the control of the image forming apparatus according to a control program and a timer program which are stored in a program ROM (read-only memory) 203. The print data is temporarily stored in a RAM (random access memory) 204. Further the ROM 203 or the RAM 204 may store predetermined data including the circumference data of the transfer roller 102 and distance data between the medium sensor 114 and the contact point of the photosensitive drum 101 and the transfer roller 102. When receiving the print instruction, the control processor 201 starts the image forming operation according to the control program. It should be noted that other necessary circuits including a develop bias supply circuit and a charge bias supply circuit are omitted for simplicity in this figure.

As will be described later, the control processor controls the voltage selection switch 112 depending on whether the spacing between recording mediums is greater than the circumference of the transfer roller 102. The spacing between recording mediums is determined based on a detection signal received from the medium sensor 114.

Hereinafter, S is defined as the circumference of the transfer roller 102. $L_{TS}$ as a distance between the medium sensor 114 and the contact point of the photosensitive drum 101 and the transfer roller 102, P as a length of the recording medium 113, and $L_I$ as an interval or an spacing between a recording medium and a subsequent recording medium. Further, assuming that the conveying velocity of the recording medium 113 is V when the transfer process is performed, the corresponding time periods are obtained as follows: $T_S$=S/V corresponding to the circumference of the transfer roller 102. $T_{TS}=L_{TS}/V$ corresponding to the distance between the medium sensor 114 and the contact point of the photosensitive drum 101 and the transfer roller 102, $T_P$=P/V corresponding to the length of the recording medium 113, and $T_1=L_I/V$ corresponding to the interval between a recording medium and a subsequent recording medium. Here, assume that the predetermined distance data S and $L_{TS}$ or the predetermined time period data $T_S$ and $T_{TS}$ are previously stored in the ROM 203.

Figure 3:
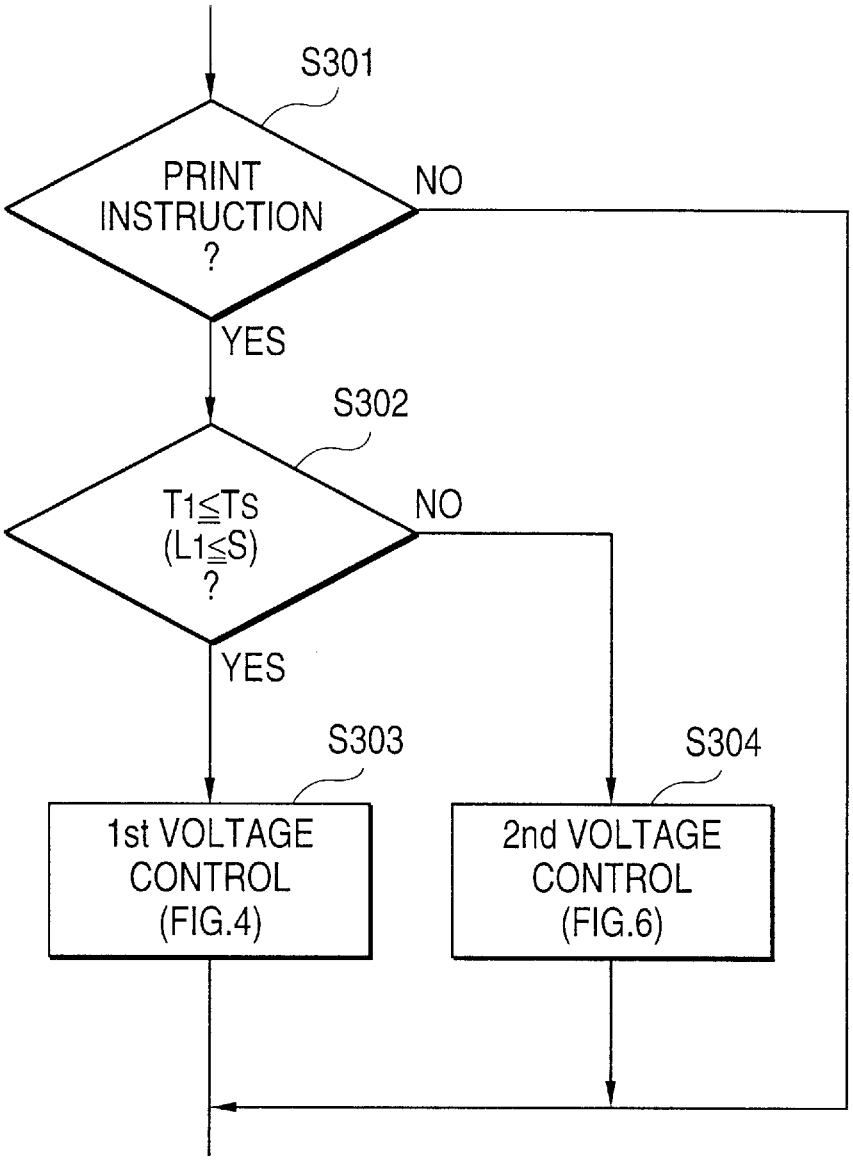
FIG. 3 is a flowchart showing an embodiment of a control method according to the embodiment.

Referring to FIG. 3, when a print instruction is received from the host computer (YES in step S301), the control processor 201 checks whether $T_I \leqq T_S$, that is, $L_I \leqq S$ (step S302). This check step is performed by, for example, monitoring an elapsed time after the detection signal of the medium sensor 114 goes high (off) through the timer program and comparing the elapsed time with the time period $T_S$. Needless to say, the time measurement may be implemented with a timer connected to the control processor 201. Alternatively, the elapsed time between a print instruction and a subsequent print instruction may be used to determine whether $L_I \leqq S$.

When $T_r \leqq T_S$ ($L_r \leqq S$) (YES in step S302), a first voltage control for the transfer roller 102 is performed (step S303) as will be described referring to FIG. 4. On the other hand, when $T_r > T_S$ ($L_r \leqq S$) (NO in step S302), a second voltage control for the transfer roller 102 is performed (step S304) as will be described referring to FIG. 6.

Referring to FIGS. 4 and 5A–5F, there is shown a first control operation in the case where $L_T \leqq S$, that is, the spacing $L_T$ is not greater than the circumference S of the transfer roller 102. When a first print instruction is received from the host computer, the control processor 201 instructs the voltage selection switch 112 to supply the negative voltage $V_{T1}$ to the transfer roller 102 and then controls the main motor 114 such that the recording medium 113 is conveyed at the predetermined speed V (see FIG. 5A). As described before, the medium sensor 113 is located upstream at a distance of $L_{TS}$ from the contact point of the photosensitive drum 101 and the transfer roller 102.

When the recording medium 113 causes the medium sensor 114 to switch on, the control processor 201 reads the time periods $T_{TS}$ and $T_S$ from the ROM 203 and calculates a time period $T_{S0}$ by subtracting a first time period $T_{S1}$ from the predetermined time period $T_{TS}$, where the first time period $T_{S1}$ is longer than the predetermined time period $T_S$ corresponding to the circumference of the transfer roller 102 by an arbitrary short time period. Until the time period $T_{S0}$ has elapsed, the negative voltage $V_{T1}$ is continuously applied to the transfer roller 102 (see FIG. 5B).

After the time period $T_{S0}$ has elapsed, the control processor 201 instructs the voltage selection switch 112 to select the second voltage $V_{T2}$ to supply it to the transfer roller 102. Until the first time period $T_{S1}$ has elapsed, the positive voltage $V_{T1}$ is continuously applied to the transfer roller 102. In other words, the positive voltage $V_{T2}$ is continuously applied to the transfer roller 102 until the recording medium 113 comes in contact with the transfer roller 102 (see FIG. 5C). Since the first time period $T_{S1}$ is longer than the time period $T_S$ corresponding to one turn of the transfer roller 102, at least one turn of the transfer roller 102 is made during the first time period $T_{S1}$ with the positive voltage $V_{T2}$ applied thereto. Therefore, the positively charged toner adhering to the surface of the transfer roller 102 is completely transferred back to the photosensitive drum 101 which will be cleaned by the cleaner 103. Subsequently, the positive voltage $V_{T2}$ is continuously applied to the transfer roller 102 and thereby the toner image on the photosensitive drum 101 is transferred to the recording medium 113 during a time period $T_{P1}$ while moving between the photosensitive drum 101 and the transfer roller 102 (see FIG. 5D).

Figure 5A:
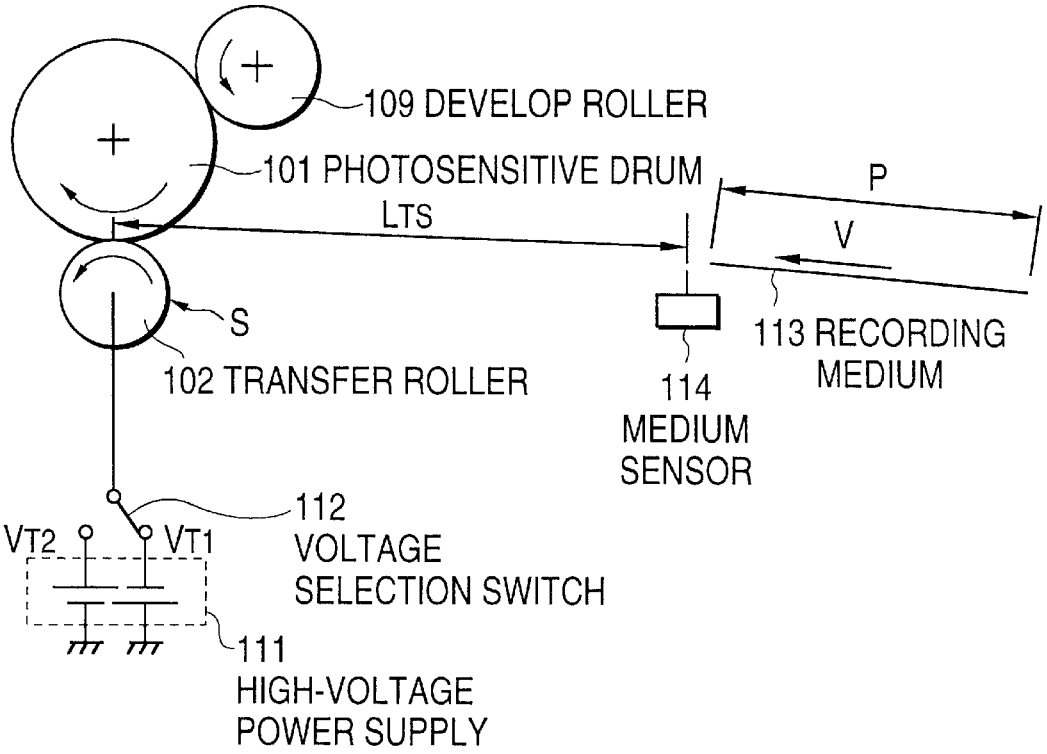
FIGS. 5A to 5F are a schematic diagram for explaining an operation of the electrophotographic image forming apparatus in the case of the relatively short print interval as shown in FIG. 4.
Figure 5B:
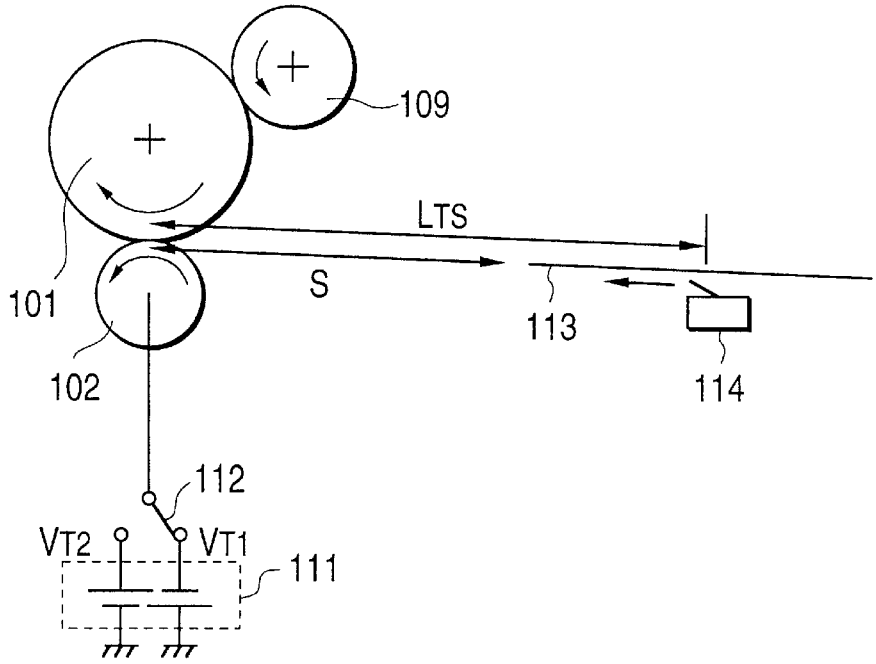
Figure 5C:
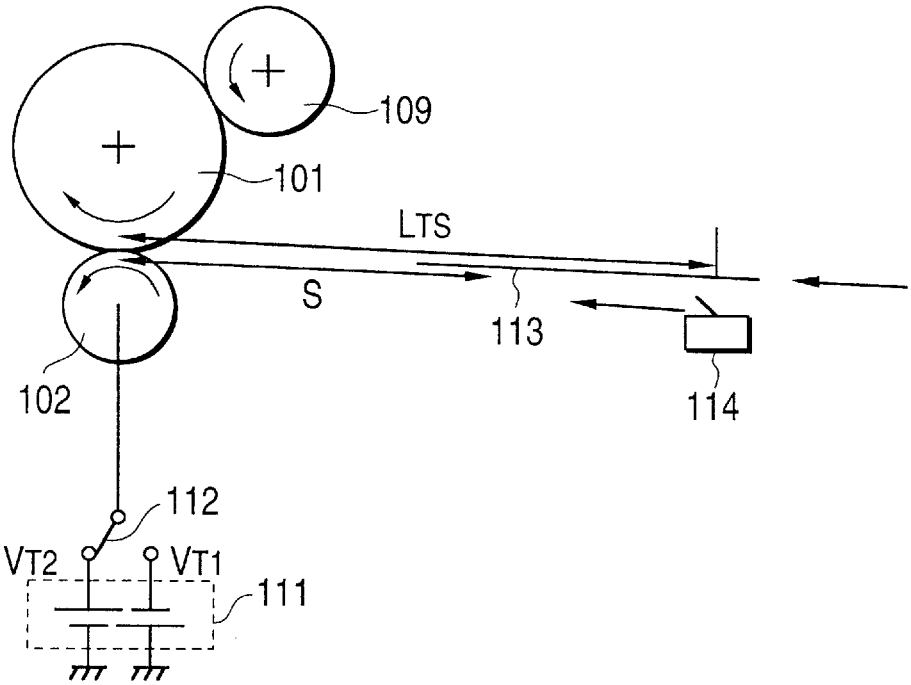
Figure 5D:
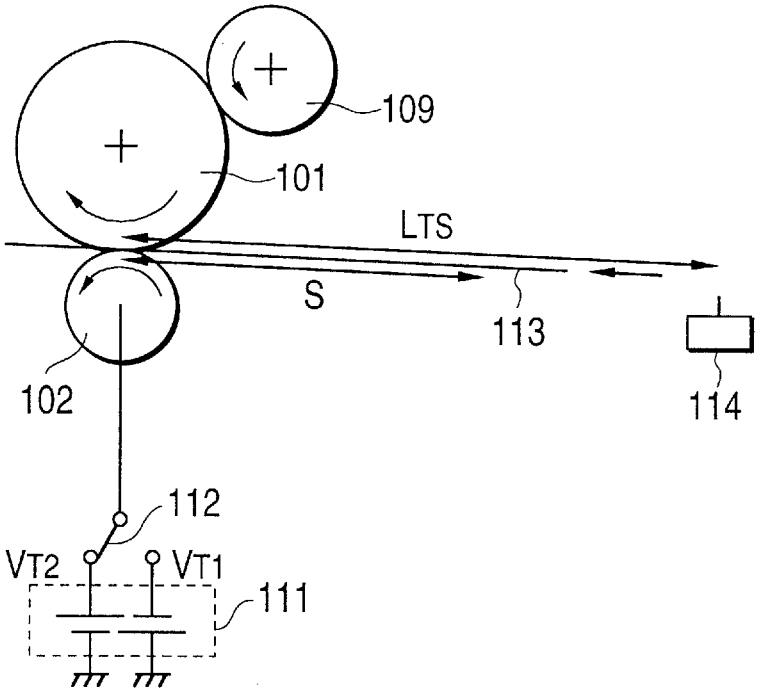
Figure 5E:
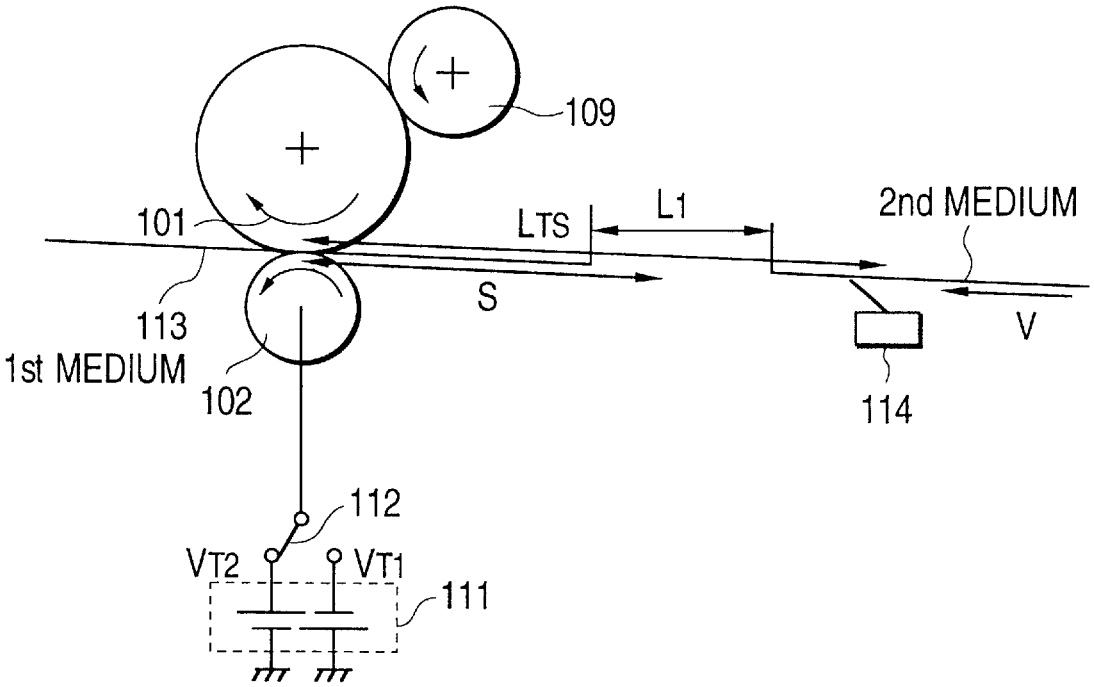
Figure 5F:
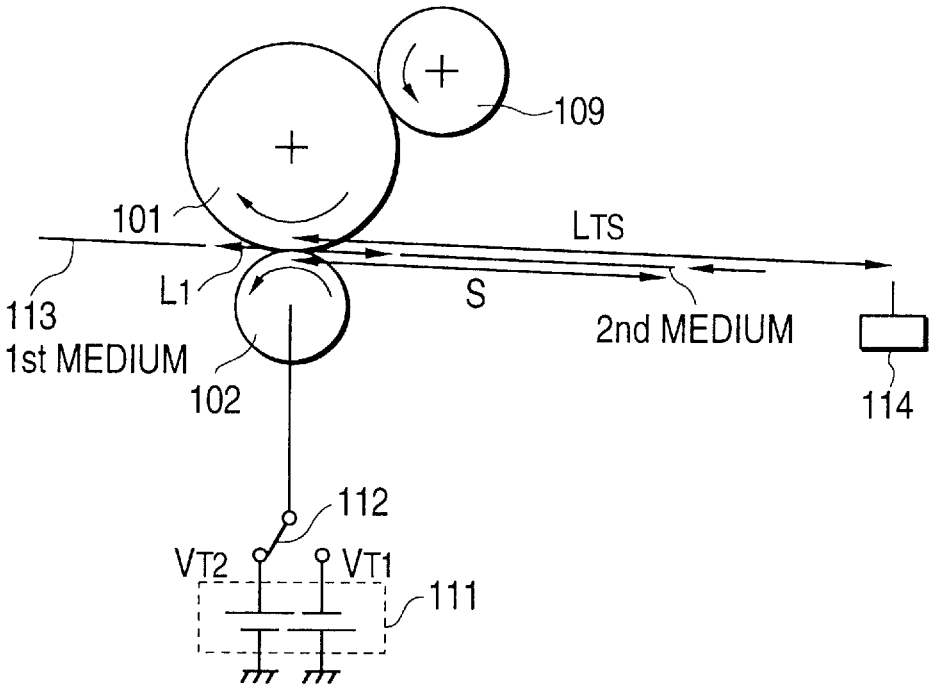

On the other hand, when the detection signal goes high (off), that is, the (first) recording medium 113 has passed through the medium sensor 114, the control processor 201 starts the timer which counts to measure an elapsed time until a subsequent (second) recording medium causes the medium sensor 114 to switch on (see FIG. 5E). In the case where a second print instruction is received during the time period $T_{P1}$, since $L_I \leqq S$, that is, the measured time period $T_I$ is not longer than the predetermined time period $T_S$ corresponding to the circumference of the transfer roller 102, the control processor 201 keeps the voltage selection switch 112 at a position of selecting the positive voltage $V_{T2}$. The reason is that a turn of the transfer roller 102 cannot be ensured during the time period $T_I$ which corresponds to the interval between the first and second recording mediums.

After the toner image on the photosensitive drum 101 has been transferred to the first recording medium, another toner image on the photosensitive drum 101 is transferred to the second recording medium during a time period $T_{r2}$ while moving between the photosensitive drum 101 and the transfer roller 102 as described before (see FIG. 5F). After that, the control processor 201 starts a print termination sequence in response to a print termination instruction received from the host computer. In this manner, the voltage applied to the transfer roller 102 is kept at the positive voltage $V_{T2}$ until the toner image transfer to the second recording medium has been terminated.

Figure 6:
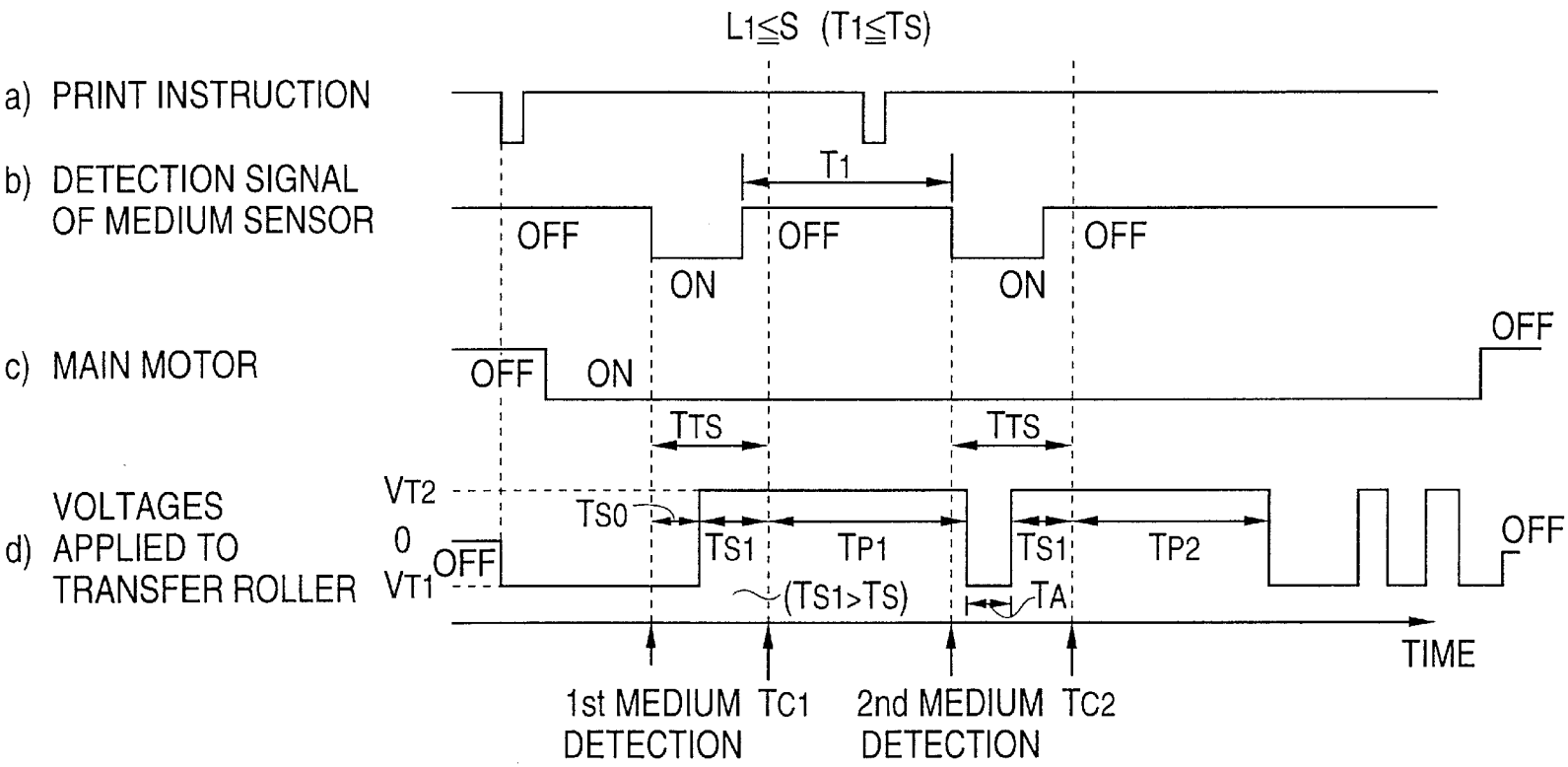
FIG. 6 is a time chart showing the control method for the transfer process in the case of a relatively long print interval.
Figure 7A:
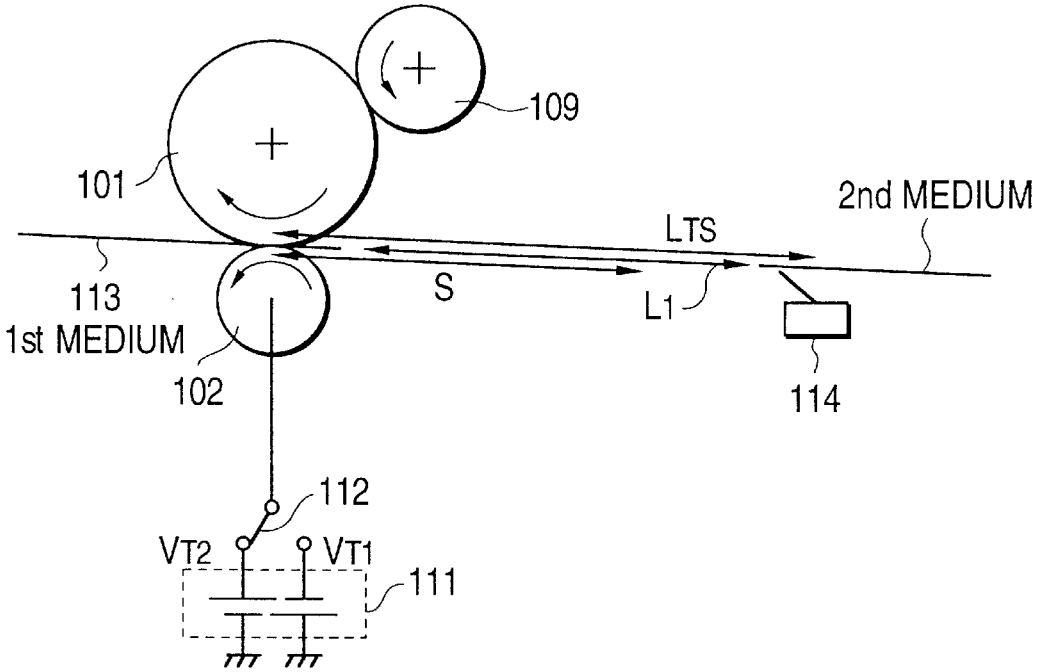
FIGS. 7A and 7B are a schematic diagram for explaining an operation of the electrophotographic image forming apparatus in the case of the relatively long print interval as shown in FIG. 6.
Figure 7B:
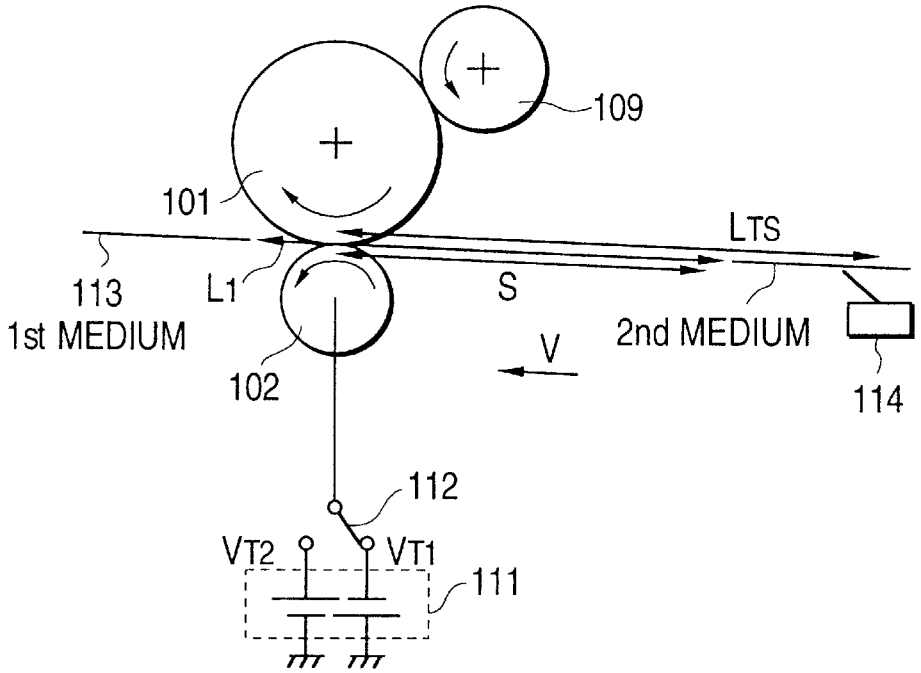

Referring to FIGS. 6, 7A and 7B, there is shown a second control operation in the case where $L_I > S$, that is, the interval $L_r$ is longer than the circumference S of the transfer roller 102. In this case, the control operation before the second recording medium is detected by the medium sensor 114 is performed according to the sequence similar to the first control operation as shown in FIG. 4, but the control operation after the second recording medium is detected by the medium sensor 114 is different. The details will be described hereinafter.

When the detection signal goes high (off), that is, the first recording medium 113 has passed through the medium sensor 114, the control processor 201 starts the timer which counts to measure an elapsed time until the second recording medium causes the medium sensor 114 to switch on (see FIG. 7A). When the second recording medium is detected by the medium sensor 114, the control processor 201 compares the measured time period $T_I$ with the time periods $T_S$. Since $T_I > T_S$ in this case, the control processor 201 calculates a time period $T_A$ after the toner image transfer to the first recording medium has been completed. The time period $T_A$ is obtained by subtracting a first time period $T_{S1}$ from the remaining period of the predetermined time period $T_{TS}$, where the first time period $T_{S1}$ is longer than the predetermined time period $T_S$ corresponding to the circumference of the transfer roller 102 by an arbitrary short time period. Until the time period $T_A$ has elapsed, the negative voltage $V_{T1}$ is applied to the transfer roller 102 (see FIG. 7B).

After the time period $T_A$ has elapsed, the control processor 201 instructs the voltage selection switch 112 to select the second voltage $V_{T2}$ to supply it to the transfer roller 102. Until the first time period $T_{S1}$ has elapsed, the positive voltage $V_{T2}$ is continuously applied to the transfer roller 102. In other words, the positive voltage $V_{T2}$ is continuously applied to the transfer roller 102 until the second recording medium comes in contact with the transfer roller 102. Since the first time period $T_{S1}$ is longer than the time period $T_S$ corresponding to the circumference of the transfer roller 102 as described before, at least one turn of the transfer roller 102 is made during the first time period $T_{S1}$ with the positive voltage $V_{T2}$ applied thereto. Therefore, the positively charged toner adhering to the surface of the transfer roller 102 is completely transferred back to the photosensitive drum 101 which will be cleaned by the cleaner 103. Subsequently, the positive voltage $V_{T2}$ is continuously applied to the transfer roller 102 and thereby the toner image on the photosensitive drum 101 is transferred to the second recording medium during a time period $T_{P2}$ while moving between the photosensitive drum 101 and the transfer roller 102.

After the toner image has been transferred to the second recording medium, the control processor 201 starts a print termination sequence in response to a print termination instruction received from the host computer. In this manner, the negative voltage $V_{T1}$ is applied to the transfer roller 102 during the timer period $T_A$ followed by the time period $T_{S1}$.

Figure 4:
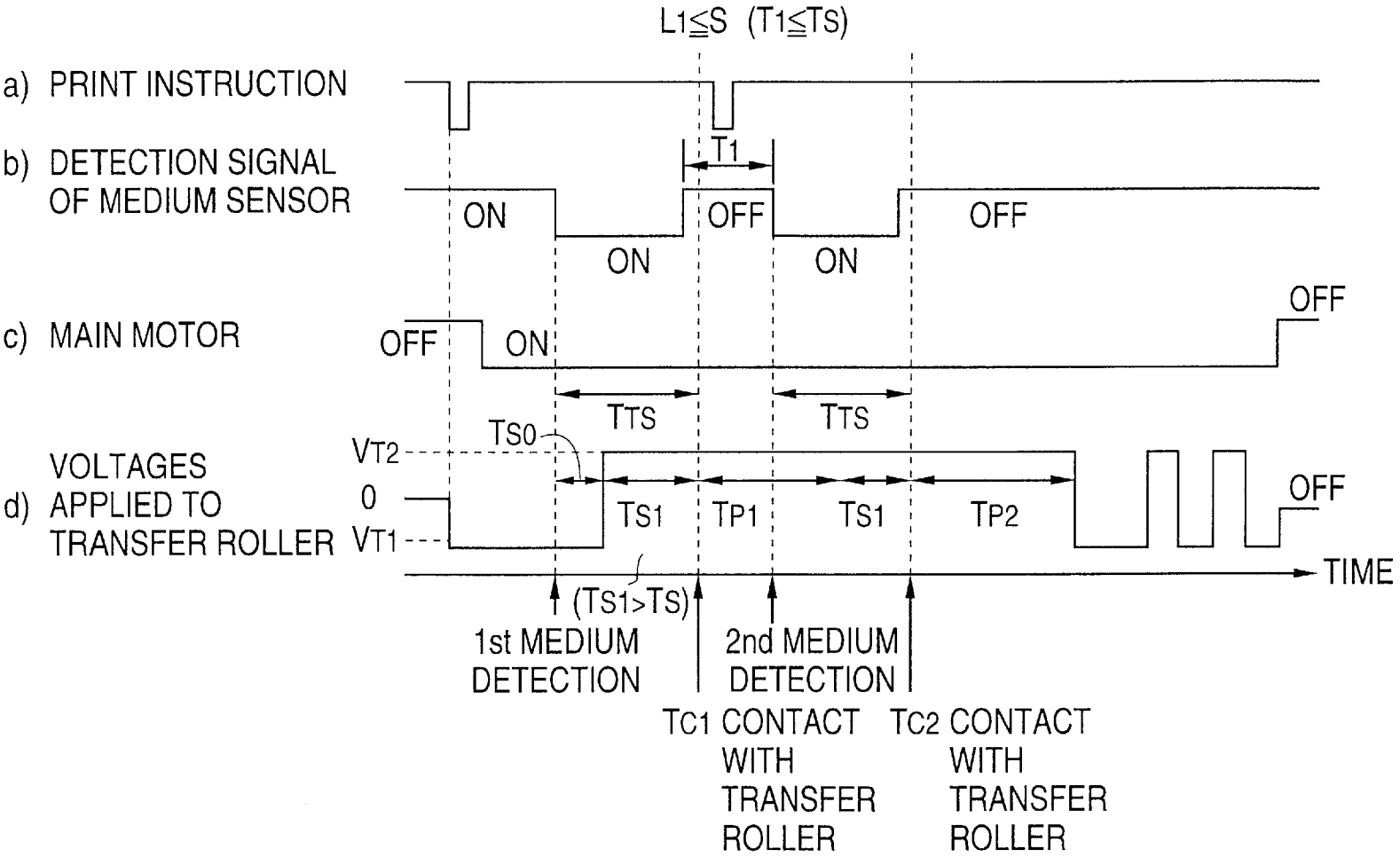
FIG. 4 is a time chart showing a control method for the transfer process in the case of a relatively short print interval.

As described above, the control processor 201 selects one of the two control sequence modes as shown in FIGS. 4 and 6 by controlling the voltage selection switch 112 depending on whether $L_I \leqq S$. Since the applied voltage to the transfer roller 102 is changed to the negative voltage $V_{T1}$ for the time period $T_1$ in the case of $L_I > S$, it can avoid the increased resistance of the transfer roller even if the transfer roller 102 is of ionic conduction.

Further, since the first time period $T_{S1}$ is longer than the time period $T_S$ corresponding to the circumference of the transfer roller 102, at least one turn of the transfer roller 102 is made during the first time period $T_{S1}$ with the positive voltage $V_{T2}$ applied thereto. Therefore, the positively charged toner adhering to the surface of the transfer roller 102 is completely transferred back to the photosensitive drum 101, which can avoid dirt on the back surface of the recording medium.

What is claimed is:

1. A control method for a transfer roller which is used to transfer a developer image on an image carrying member to a recording medium according to an electorphotographic process, the control method comprising the steps of:

detecting an interval between a first recording medium and a second recording medium which follows the first recording medium; and selecting one of a first control mode and a second control mode depending on whether the interval is longer than a circumference of the transfer roller after a first transfer to the first recording medium is completed, such that the first control mode is selected when the interval is not longer than the circumference of the transfer roller and the second control mode is selected when the interval is longer than the circumference of the transfer roller, the first control mode being such that the transfer roller is kept at a first voltage until a second transfer to the second recording medium is completed, and the second control mode being such that the transfer roller changes between the first voltage and a second voltage before the second transfer to the second recording medium, the first voltage and the second voltage being opposite in polarity.

2. The control method according to claim 1, wherein, in the second control mode, the second voltage is applied to the transfer roller for a first time period and then the first voltage is applied to the transfer roller for a second time period following the first time period.

3. The method according to claim 1, wherein the interval is detected from a trailing edge of the first recording medium and a leading edge of the second recording medium.

4. The method according to claim 1, wherein the interval is detected based on a time interval between successive print instructions corresponding to the first and second recording medium, respectively.

5. The method according to claim 2, wherein the second time period is longer than a time period corresponding to one turn of the transfer roller.

6. A control apparatus for a transfer roller which is used to transfer a developer image on an image carrying member to a recording medium according to an electorphotographic process, the control apparatus comprising:

a detector for detecting an interval between a first recording medium and a second recording medium which follows the first recording medium;

a selector for selecting one of a first voltage and a second voltage to supply a selected one to the transfer roller, the first voltage and the second voltage being opposite in polarity; and a controller for selecting one of a first control mode and a second control mode depending on whether the interval is longer than a circumference of the transfer roller after a first transfer to the first recording medium is completed, such that the first control mode is selected when the interval is not longer than the circumference of the transfer roller and the second control mode is selected when the interval is longer than the circumference of the transfer roller, the first control mode being such that the selector continuously selects the first voltage until a second transfer to the second recording medium is completed, and the second control mode being such that the selector alternately selects the first voltage and the second voltage before the second transfer to the second recording medium.

7. The control apparatus according to claim 6, wherein, in the second control mode, the selector selects the second voltage for a first time period and then selects the first voltage for a second time period following the first time period.

8. The control apparatus according to claim 6, wherein the detector comprises:

a medium sensor for sensing a recording medium having a predetermined length to produce a sensor signal; and an interval detector for detecting the interval from sensor signals of the first and second recording mediums.

9. The control apparatus according to claim 8, wherein the medium sensor is located at a predetermined distance from a contact point of the image carrying member and the transfer roller.

10. The control apparatus according to claim 8, wherein the interval detector detects the interval from a trailing edge of the first recording medium and a leading edge of the second recording medium.

11. The control apparatus according to claim 10, wherein the interval detector comprises a timer which counts to detect the interval from a trailing edge of the first recording medium and a leading edge of the second recording medium.

12. The control apparatus according to claim 7, wherein the second time period is longer than a time period corresponding to one turn of the transfer roller.

13. An image forming apparatus for forming an image on a recording medium according to an electorphotographic process, comprising:

an image carrying member for forming an electrostatic latent image thereon:

a develop roller for developing the electrostatic latent image into a developer image on the image carrying member:

a transfer roller for transferring the developer image on the image carrying member to a recording medium intervening between the image carrying member and the transfer roller;

a conveyer for conveying a recording medium toward a contact portion of the image carrying member and the transfer roller;

a bias supplier for producing a positive bias voltage and a negative bias voltage;

a detector for detecting an interval between a first recording medium and a second recording medium which are conveyed by the conveyer with the first recording medium following the first recording medium;

a selector for selecting one of the positive voltage and the negative voltage to supply a selected one to the transfer roller; and a controller for selecting one of a first control mode and a second control mode depending on whether the interval is longer than a circumference of the transfer roller after a first transfer to the first recording medium is completed, such that the first control mode is selected when the interval is not longer than the circumference of the transfer roller and the second control mode is selected when the interval is longer than the circumference of the transfer roller, the first control mode being such that the selector selects a first voltage having a polarity opposite to the developer image on the image carrying member until a second transfer to the second recording medium is completed, and the second control mode being such that the selector alternately selects the positive and negative voltages before the second transfer to the second recording medium.

14. The image forming apparatus according to claim 13, wherein, in the second control mode, the selector selects a second voltage having the same polarity as the developer image for a first time period and then selects the first voltage for a second time period following the first time period.

15. The image forming apparatus according to claim 13, wherein the detector comprises:

a medium sensor for sensing a recording medium having a predetermined length to produce a sensor signal; and an interval detector for detecting the interval from sensor signals of the first and second recording mediums.

16. The image forming apparatus according to claim 15, wherein the medium sensor is located at a predetermined distance from a contact point of the image carrying member and the transfer roller.

17. The image forming apparatus according to claim 15, wherein the interval detector detects the interval from a trailing edge of the first recording medium and a leading edge of the second recording medium.

18. The image forming apparatus according to claim 13, wherein the second time period is longer than a time period corresponding to one turn of the transfer roller.

* * * * *